US006583086B1

(12) United States Patent
Yoneshige et al.

(10) Patent No.: US 6,583,086 B1
(45) Date of Patent: Jun. 24, 2003

(54) THERMALLY SENSITIVE RECORDING MEDIUM

(75) Inventors: Seiki Yoneshige, Kita-ku (JP); Tomoyuki Nakano, Kita-ku (JP); Reiji Ohashi, Kita-ku (JP)

(73) Assignee: Nippon Paper Industries Co. Ltd., Tokyo (JP)

( * ) Notice: Subject to any disclaimer, the term of this patent is extended or adjusted under 35 U.S.C. 154(b) by 183 days.

(21) Appl. No.: 09/589,769

(22) Filed: Jun. 9, 2000

(30) Foreign Application Priority Data

Jun. 14, 1999 (JP) ..... 11-166834
Jun. 14, 1999 (JP) ..... 11-166835

(51) Int. Cl.[7] ..... B41M 5/30
(52) U.S. Cl. ..... 503/209; 503/208; 503/216
(58) Field of Search ..... 503/208, 209, 503/216

(56) References Cited

U.S. PATENT DOCUMENTS 4,771,033 A * 9/1988 Shimizu et al. ..... 503/209
5,102,857 A 4/1992 Okada ..... 503/209
5,348,930 A * 9/1994 Kobayashi et al. ..... 503/209
5,888,929 A * 3/1999 Iida et al. ..... 503/201

FOREIGN PATENT DOCUMENTS

EP 0-466096 A1 1/1992

OTHER PUBLICATIONS

Abstract of Japanese Patent Laid Open Publication No. 59–187889A for Appln. No. 58–061710 corresponding to Japanese Patent Publ. No. 4–38599.

Abstract of Japanese Patent Laid Open Publication No. 61–139486A for Appln. No. 59–262266 corresponding to Japanese Patent Publ. No. 3–69318.

* cited by examiner

*Primary Examiner*—Bruce H. Hess
(74) *Attorney, Agent, or Firm*—Sherman & Shalloway

(57) ABSTRACT

A thermally sensitive recording medium that contains a compound represented by general formula (1) as a color developer, and a compound represented by general formula (2) or general formula (3) as a sensitizer. The said thermally sensitive recording medium has sufficient color developing sensitivity with lower impressive energy, and has good image preservability of recorded part, good resistance to humid and heat resistance of background white paper part.

(1)

(2)

(3)

In the formulae, $R^1$ represents a hydrogen atom, a methyl group or a chlorine atom, $R^2$ and $R^3$ represents a methyl group, an alkoxy group or an allyloxy group, m and n represents an integer of 1–5, $R^4$ represents an alkyl group, an alkoxy group of carbon number 1–6 or an electron withdrawing group and o represents an integer of 0–2.

4 Claims, No Drawings

THERMALLY SENSITIVE RECORDING MEDIUM

BACKGROUND OF THE INVENTION

1. Field of the Invention

The present invention relates to a thermally sensitive recording medium that has an excellent color developing ability, and is superior to the existing one in the preservability of developed color image and the stability of blank part.

2. Description of the Prior Art

Generally, a thermally sensitive recording medium can be obtained by spreading a coating, on a substrate such as paper, synthetic paper or plastic which is prepared by the preparation method mentioned below, and develops color record by instant chemical reaction with heating by a thermal head, a hot stamp, laser beam and others. Namely, a colorless or pale colored dye precursor, which is an electron donating compound, and a color developer, which is an electron accepting compound, are separately ground to fine particles and mixed together, then additives such as a binder, a filler, a sensitizer or a slipping agent are added, and the coating is obtained. The thermally sensitive recording media are widely applied in various fields such as a recorder for measuring equipment, a terminal printer of computer, a facsimile, an automatic ticket vending machine and a bar cord label. Recently, along with the diversity of recording equipments and the progress of high quality machines, the high speed printing and high speed image recording become possible, and more excellent quality is required to the recording sensitivity of thermally recording medium.

As a method to satisfy the said requirement, the method to use a sensitizer with a dye and a color developer is proposed. For example, in a case that the color developers are phenolic compounds represented by bis-phenol A, p-benzyl biphenyl (Japanese Patent Laid open Publication 60-82382), p-benzyl oxybenzoicbenzoate (Japanese Patent Laid open Publication 57-201691) and benzylnaphtyl ether (Japanese Patent Laid open Publication 58-87094) are used as the desirable sensitizers. When a sensitizer is used, at first, the sensitizer is molten by heating and the molten sensitizer dissolves basic dye and color developer and mixes them by molecular size level, and the color developing reaction occurs. Therefore, the kind of sensitizer, basic dye and color developer to be used must be chosen by careful consideration In Japanese Patent Publication 4-38599, a thermally sensitive recording medium prepared by combining aromatic ether as a sensitizer to a color developer 4-hydroxy-4'-methyldiphenylsulfone is proposed, and also in Japanese Patent Publication 4-38599, a thermally sensitive recording medium prepared by combining 1,4 substituted naphthalene derivatives as a sensitizer to a color developer 4hydroxy-4'-methyldiphenylsulfone is proposed. The thermally sensitive recording media obtained by mentioned combination can achieve a good color developing sensitivity by higher impressive energy, however, when printed by lower impressive energy or by high speed, a sufficient color developing sensitivity can not be obtained, and the application to an equipment by the said printing condition is impossible. Further, in general, when the color developing sensitivity is improved by adding sensitizer, the occurrence of the problem that the heat resistance of blank part deteriorates, is pointed out.

BRIEF SUMMARY OF THE INVENTION

The object of this invention is to provide a thermally sensitive recording medium that has high color developing sensitivity at lower impressive energy printing and whose image preservation of printed part and the stability of background color of blank part (against to humidity and heat) are improved.

The present invention is to provide a thermally sensitive material in which a compound represented by following general formula (1) as a color developer and diphenylsulfone compound represented by following general formula (2) or an aromatic compound possessing aminosulfonyl group (—$SO_2NH_2$) represented by general formula (3) as a sensitizer in a thermally sensitive color developing layer.

(1)

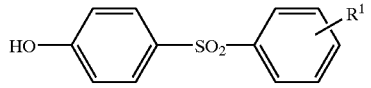

(2)

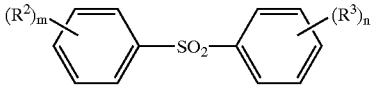

(3)

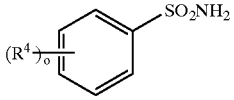

$R^1$ represents a hydrogen atom, a methyl group or a chlorine atom, $R^2$ and $R^3$ represent a methyl group, an alkoxy group or an allyloxy group, m and n represent an integer of 1–5, $R^4$ represents an alkyl group, an alkoxy group of carbon number 1–6 or an electron withdrawing group and o represents an integer of 0–2.

In the present invention, at least one kind of compound represented by general formula (1) is used as a color developer. In a case when $R^1$ is a methyl group, heat resistance of blank part is improved, and in a case of a hydrogen atom, color developing sensibility is improved. From the view point of preservability, $R^1$ is desirable to be located at p position to a sulfone group.

Further, in the present invention, at least one kind of compound represented by general formula (2) or general formula (3) is used as a sensitizer. In general formula (2), $R^2$ and $R^3$ can be a hydrogen atom or a substituted group that does not spoil the sensitizer effect, and as the concrete example, methyl group, alkoxy group of carbon number 1–6 or allyloxy group can be mentioned. In general formula (3), $R^4$ can be a substitution group that does not spoil the sensitizer effect, and as the concrete example, alkyl or alkoxy group of carbon number 1–6 such as methyl group, ethyl group or electron withdrawing group such as chlorine atom or nitro group can be mentioned.

As the concrete compounds represented by general formula (2), compounds (2-1)–(2-11) can be mentioned, however, the examples are not limited to them. Among these compounds, a compound of (2-1) is desirably used because when it is used with 4-hydroxy-4'-methyldiphenylsulfone, which is a color developer, the effect becomes better.

(2-1)

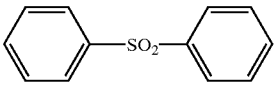

-continued
(2-2)
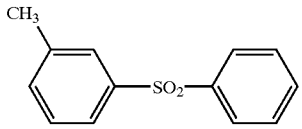
(2-3)
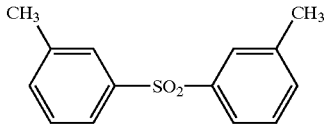
(2-4)
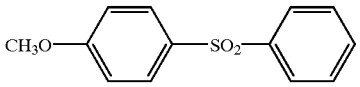
(2-5)
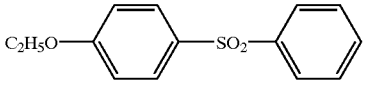
(2-6)
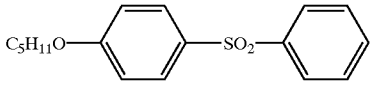
(2-7)
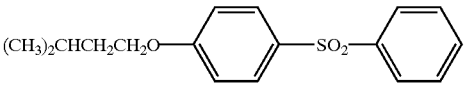
(2-8)
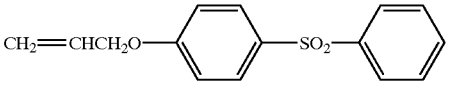
(2-9)
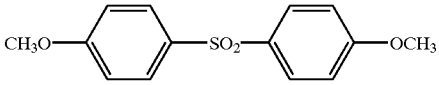
(2-10)
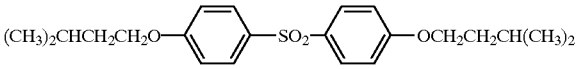
(2-11)
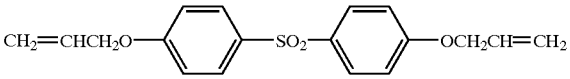
The concrete examples of compound represented by general formula (3), compounds (3-1)–(3-30) can be mentioned, however, the examples are not limited to these compounds. Among these compounds, (3-2) and (3-4) can be desirably used, because when compound (1) is used as a color developer, the said two compounds can give a good sensitizing effect.
(3-1)
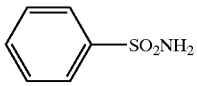
(3-2)
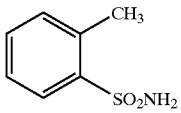
-continued
(3-3)
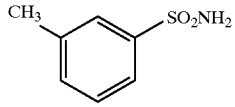
(3-4)
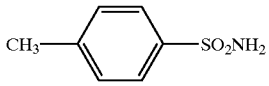
(3-5)
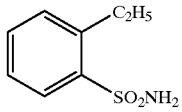
(3-6)
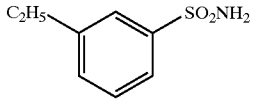
(3-7)
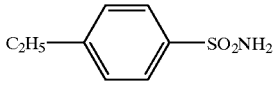
(3-8)
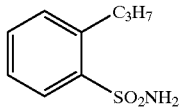
(3-9)
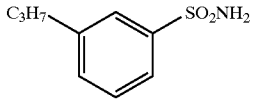
(3-10)
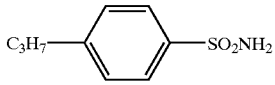
(3-11)
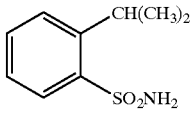
(3-12)
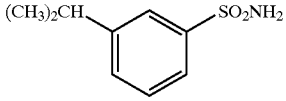
(3-13)
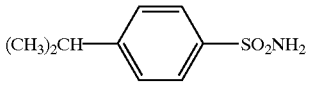
(3-14)
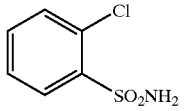
(3-15)
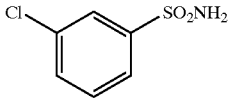
(3-16)
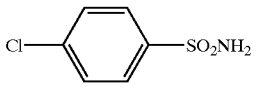

-continued (3-17)

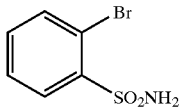

(3-18)

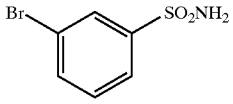

(3-19)

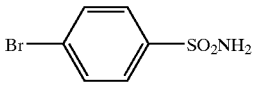

(3-20)

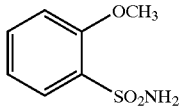

(3-21)

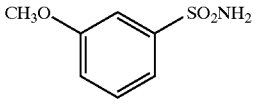

(3-22)

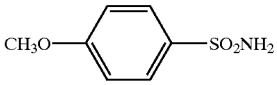

(3-23)

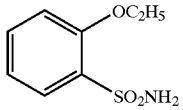

(3-24)

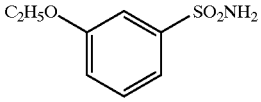

(3-25)

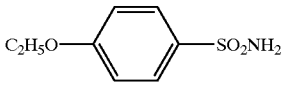

(3-26)

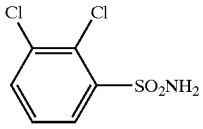

(3-27)

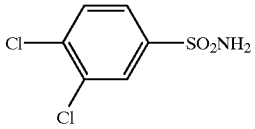

(3-28)

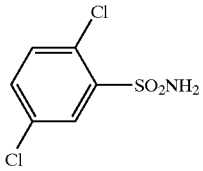

(3-29)

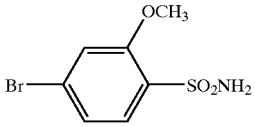

-continued (3-30)

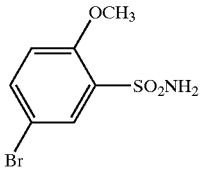

In the present invention, if the content of the sensitizer represented by general formula (2) or (3) is too small, the sensitizing effect is not enough, and if it is too much, the color developing density becomes poor. In the present invention, the desirable content of the sensitizer represented by general formula (2) or (3) is 0.01–5 parts to 1 part of color developer, and more desirably, 0.01–2 parts.

DETAILED DESCRIPTION OF THE INVENTION

For the preparation of the thermally sensitive recording medium of this invention, well known conventional method can be used. Concretely, following method can be used. Namely, color developer, dye precursor and sensitizer is separately ground to fine particles by means of a grinder such as ball mill, attreiter or sand grinder or by means of an adequate emulsifying apparatus, fillers and other kinds of additive are added, then dispersed in aqueous solution of water soluble binder so as to obtain a coating. The obtained coating is coated over the surface of voluntary substrate using various kinds of coater such as air knife coater, blade coater or roll coater.

As the thermally sensitive recording method utilizing color developing reaction between an electron donating compound and an electron accepting compound in this invention, combination of dye precursor and color developing agent, diazonium salt and coupler, transition element such as iron and chelete compound or aromatic isocyanate compound and imino compound can be mentioned. From the view point of color density and recording sensitivity, the thermally sensitive recording medium that utilize the color developing reaction between dye precursor and color developer is illustrated in detail as follows, because the combination of a dye precursor and a color developer developing gives better result,.

As a dye precursor used in this invention, various kinds of well known compounds can be used. These compounds can be used alone or by mixing two kinds or more, and are selected according to the uses or required characteristics. The following compounds can be mentioned as the concrete examples, however, dye precursors are not restricted to them.

(1) Triallylmethane Compound 3,3'-bis(4-dimethylaminophenyl)-6-dimethylaminophthalide <commodity name: Crystal Violet Lactone, CVL>, 3-(4-dimethylamino-2methylphenyl)-3-(4-dimethylaminophenyl)phthalide, 3,3'-bis(2-(4-dimethylaminophenyl)-2-(4-methoxyphenyl)ethenyl)-4,5,6,7-tetra chlorophthalide <NIR-Black>

3,3'-bis(4-dimethylaminophenyl) phthalide <MGL>, 3-(4-dimethylaminophenyl)-3-(1,2-dimethylindole-3-yl)phthalide, 3-(4-dimethylaminophenyl)-3-(2-phenylindole-3-yl)phthalide, 3,3'-bis(4-ethylcarbazole-3-yl)-3-dimethylaminophthalide, 3,3'-bis(1-ethyl-2-methylindole-3-yl)phthalide <indolylred>, 3,3'-bis(2-phenylindol-3-yl)-5-dimethylaminophthalide and tris(4-dimethylaminophenyl)methane <LCV>can be mentioned.

(2) Diphenylmethane Type Compound 4,4'-bis(dimethylamino)benzhydrinbenzyleter,

N-halophenyl-leucoauramine and

N-2,4,5-trichlorophenyl leuco auramine can be mentioned.

(3) Xanthene Type Compound, rhodamine B-anilinolactam, 3-diethylamino-7-dibenzylaminofluoran, 3-diethylamino-7-butylaminofluoran, 3-diethylamino-7-anilinofluoran <Green-2>, 3-diethylamono-7-(2-chloroanilino)fluoran, 3-dibutylamino-7-(2-chloroanolino)fluoran <TH-107>, 3-diethylamino-7-(3-trifluoromethylanolino)fluoran <Black-100>, 3-diethylamino-6-methyl-7-anilinofluoran <ODB>, 3-dibuthylamino-6-methyl-7-anilinofluoran <ODB-2>, 3-piperidino-6-methyl-7-anilinofluoran, 3-(N-isoamyl-N-ethylamino)-6-methyl-7-anilinofluoran <S-205>, 3-(N-ethyl-N-torylamino)-6-methyl-7-anilinofluoran, 3-(N-cyclohexyl-N-methylamino)-6-7-anilinofluoran <PSD-150>, 3-diethylamino-6-chloro-7-(β-ethoxyethylamino)fluoran, 3-diethylamino-6-chloro-7-(γ-chloropropylamino)fluoran, 3-cyclohexylamino-6-chlorofluoran <OR-55>, 3-diethylamino-6-chloro-7-anilinofluoran, 3-(N-cyclohexyl-N-methylamino)-6-methyl-7-anilinofluoran and 3-diethylamino-7-phenylfluoran can be mentioned.

(4) Thiazine Type Compound, benzoylleucomethyleneblue and p-nitrbenzoylleucomethyleneblue can be mentioned.

(5) Spiro Type Compound 3-methylspirodinaphthopyran, 3-ethylspirodinaphthopyran, 3-benzylspirodinaphthopyran and 3-methylnaphth-(6'-methoxybenzo)spiropyran can be mentioned.

(6) Pentadiene Type Compound 1,1,5,5-tetrakis(4-dimethylaminophenyl)-3-methoxy-1, 4-pentadiene, 1,1,5,5-tetrakis(4-dimethylaminophenyl)-1 and 4-pentadiene can be mentioned.

In the present invention, a color developer represented by general formula (1) and one or more kind of conventional color developer can be used. As the concrete examples of color developer that can be used in this invention, the following compounds can be mentioned. Namely, bisphenols such as 2,2-bis(4-hydroxyphenyl)propane, 1,7-di(4-hydroxyphenylthio)-3,5-dioxaheptane or 4,4'-cyclohexylidenediphenol, 4-hydroxy benzoic esters such as 4-hydroxybenzyl benzoate, 4-hydroxyethyl benzoate, 4-hydroxynormalpropyl benzoate, 4-hydroxyisopropyl benzoate or 4-hydroxybutyl benzoate 4-hydroxy diester phthalates such as 4-hydroxydimethylphthalate, 4-hydroxydiisopropylphthalate, 4-hydroxydibenzylphthalate or 4-hydroxydiheylphthalate phthalic acid monoesters such as monobenzyl phthalate, monocyclohexyl phthalate, monophenyl phthalate or monomethylphenyl phthalate bishydroxyphenylsulfides such as bis(4-hydroxy-3-tert-butyl-6-methylphenyl)sulfide, bis(4-hydroxy-2,5-dimethylphenyl)sulfide or bis(4-hydroxy-2-methyl-5-ethylphenyl) sulfide, 4-hydroxyphenylarylsulfones such as 4-hydroxy-4'-isopropoxydiphenylsulfone or 4-hydroxy-4'-normalpropoxydiphenylsulfone, 4-hydroxyphenylarylsulfonates such as 4-hydroxyphenylbenzensulfonate, 4-hydroxyphenyl-p-tolylsulfonate or 4-hydroxyphenyl-p-chlorobenzensulfonate, 1,3-di [2-(hydroxyphenyl)-2-propyl]benzenes such as 1,3-di[2-(4-hydroxyphenyl)-2-propyl]benzene or 1,3-di [2-(4-hydroxy-3-methylphenyl)-2-propyl]benzene, 4-hydroxybenzoyloxybenzoic esters such as 4-hydroxybenzoyloxy benzyl benzoate, 4-hydroxybenzoyloxy methyl benzoate, 4-hydroxybenzoyloxy ethyl benzoate, 4-hydroxybenzoyloxy normalpropyl benzoate, 4-hydroxybenzoyloxy isopropyl benzoate or 4-hydroxybenzoyloxy butyl benzoate, bishydroxyphenylsulfones such as bis(3-tert-butyl-4-hydroxy-6-methylphenyl)sulfone, bis(3-ethyl-4-hydroxyphenyl)sulfone, bis(3-propyl-4-hydroxyphenyl)sulfone, bis(3-isopropyl-4-hydroxyphenyl) sulfone, bis(3-ethyl-4-hydroxyphenyl)sulfone, bis(4-hydroxyphenyl)sulfone, 2-hydroxyphenyl-4'-hydroxyphenylsulfone, bis(3-chloro-4-hydroxyphenyl)sulfone or bis(3-bromo-4-hydroxyphenyl)sulfone, phenols such as p-tert-butylphenol, p-phenylphenol, p-benzylphenol, 1-naphthol or 2-naphthol, metal salt of aromatic calboxylic acid such as benzoic acid, p-tert-butyl benzoic acid, trichloro benzoic acid, 3-sec-butyl-4-hydroxy benzoic acid, 3-cyclohexyl-4-hydroxy benzoic acid, 3,5-dimethyl-4-hydroxy benzoic acid, terephthalic acid, salicylic acid, 3-isopropyl salicylic acid or 3-tert-butyl salicylic acid can be mentioned.

In the present invention, one or more kinds of a conventional sensitizer can be used with a sensitizer represented by general formula (2) or (3), and concrete examples are mentioned below, however, the present invention is not limited to them.

Namely, stearic acid amide, palmitic acid amide, methoxycarbonyl-N-stearic acid benzamide N-benzoyl stearic acid amide, N-eicosanic acid amide, ethylenbis stearamide, ethylenbis stearic acid amide, behenic acid amide, methylenbis stearic acid amide, methylolamide, N-methylol stearic acid amide, terephthalic acid dibenzyl, terephthalic acid dimethyl, terephthalic acid dioctyl, p-benzyloxy benzoic acid benzyl, 1-hydroxy-2-naphthoic acid phenyl, oxalic acid dibenzyl, oxalic acid-di-methylbenzyl, oxalic acid-di-p-chlorobenzyl, 2-naphthylbenzylether, m-terphenyl,
p-bebzylbiphenyl,
tolylbiphenylether,
di (p-methoxyphenoxyethyl) ether,
1,2-di(3-methylphenoxy)ethane,
1,2-di (4-methylphenoxy)ethane,
1,2-di (4-methoxyphenoxy)ethane,
1,2-di (4-chlorophenoxy)ethane,
1,2-diphenoxyethane,
1-(4-methoxyphenoxy)-2-(2-methylphenoxy) ethane,
p-methylthiophenylbenzylether,
1,4-di (phenylthio)butane,
p-acetotoluidide,
p-acetophenetidide,
N-acetoacethyl-p-toluidine,
Di(biphenylethoxy) benzene,
p-di(vinyloxyethoxy)benzene and
1-isopropylphenyl-2-phenylethane can be mentioned.

In the thermally sensitive recording medium of this invention, for the stabilization at the long term preservation, a preservative stabilizer can be used. As the concrete example of the preservative stabilizer, hindered phenol compound such as
1,1,3-tris(methyl-4-hydroxy-5-tert-butylphenyl)butane,
1,1,3-tris(2-methyl-4-hydroxy-5-cyclohexylphenyl)butane,
4,4'-butylidenbis(2-tert-butyl-5-methylphenyl),
4,4'-thiobis(2-tert-butul-5-methylphenol),
2,2'-thiobis(6-tert-butyl-4-methylphenol),
2,2'-methylenebis.(6-tert-butyl-4-methylphenol),
4-benzyloxy-4'-(2-methylglycidyloxy)diphenylsulfone or sodium 2,2'-methylenebis(4,6-di-tert-butylphenyl) phosphate can be mentioned. In general, 0.1–10 weight parts of these preservative stabilizers is used to 1 part of dye precursor.

As the concrete examples of binder used in each layers of the thermally sensitive recording medium of this invention, water soluble binder such as starches, hydroxyethylcellulose, methylcellulose, carboxymethylcellulose, gelatin, casein, Arabic gum, polyvinylalcohol, carboxy denatured polyvinylalcohol, acetoacetyl group denatured polyvinylalcohol, silicon denatured polyvinylalcohol, alkali salt of isobutylene-maleic acid anhydride copolymer, alkali salt of styrene-maleic acid anhydride copolymer, alkali salt of ethylene-maleic acid anhydride copolymer, alkali salt of styrene-acrylic acid copolymer, latexes such as styrene-butadiene copolymer, acrylonitrile-butadiene copolymer or methylacrylate-butadiene copolymer, water dispersible binder such as urea resin, melamine resin, amide resin or polyurethane resin can be mentioned.

Further, as a filler, inorganic filler such as activated clay, clay, calcined clay, diatomaceous earth, talc, kaoline, calcined kaoline, calcium carbonate, magnesium carbonate, barium carbonate, titanium oxide, zinc oxide, silicon oxide or aluminium hydroxide, organic filler such as urea-formalin resin, polystyrene resin, phenol resin or cup shape styrene-butadiene rubber resin can be used.

Furthermore, for the purpose to prevent the wearing out of a thermal head and to prevent the sticking, a heat fusing material can be added. For example, animal waxes such as bees wax or shellac wax, vegetable waxes such as carnauba wax, mineral waxes such as montan wax, petroleum waxes such as microcrystalline wax, higher fatty acid amide such as higher fatty acid polyhydric alcohol ester or stearic acid amide, higher fatty acid metal salt such as zinc stearate or calcium stearate, synthetic wax such as higher amine, condensation product of fatty acid and amine, condensation product of aromatic and amine, synthetic paraffin, chlorinated paraffin, oxidized paraffin, higher straight chain glycol, 3,4-epoxyhexahydro phthalic acid dialkyl, polyethylene or polyethylene oxide can be mentioned.

Still more, a dispersing agent such as sodium dioctylsulfo succinate, an ultraviolet ray absorbing agent such as benzophenone type or triazole type, a surface active agent, a defoamer, a fluorescent brightening agent, a waterproof agent, a slipping agent or an antioxidant can be used at need.

As a substrate of the thermally sensitive recording medium, paper such as high quality paper, middle quality paper, coated paper or recycled paper can be mainly used, and various kinds of nonwoven cloth, plastic film, synthetic paper and metal foil can be used, further the complex sheet of these materials can be used voluntarily.

The thermally sensitive recording medium of this invention can be prepared by use of materials mentioned above and by conventional methods. The preparation method of a coating for each layer of thermally sensitive recording medium is not restricted, and in general, water is used as a dispersing medium, a binder and a filler or a slipping agent which is used at need are added, mixed and stirred, thus the coating can be prepared. In a case of the thermally sensitive layer, a dye precursor and a color developer are added.

As a method to prepare a dye precursor and a color developer, following well known methods can be mentioned. Namely, a method to obtain an aqueous coating by grinding and dispersing a dye precursor and a color developer separately in water using a sand grinder, an attriter or a ball mill, then mixing said two dispersions together with, or a method to obtain an aqueous coating by immobilizing a dye precursor or a color developer in microcapsules. The mixing ratio of dye precursor and color developer is decided according to the kind of dye precursor and color developer and not restricted, however, 0.5–50 weight parts, desirably 2–10 weight parts of color developer to 1 part of dye precursor is used.

The forming method of each layer of the thermally sensitive recording medium is not restricted, and an air knife coating, a Vali bar blade coating, a pure blade coating, a rod blade coating, a Shore-dwell coating, a curtain coating and a dye coating can be used. For example, the coating for a thermally sensitive recording layer is coated over the surface of the substrate and dried up, then the coating for a protecting layer is coated over the thermally sensitive recording layer and dried up. The coating amount of the coating for a thermally sensitive recording layer is 2–12 g/m$^2$, desirably 3–10 g/m$^2$ by dry weight, and the coating amount for a middle layer or a protecting layer is 0.1–15 g/m$^2$, desirably 0.5–7 g/m$^2$by dry weight.

Further, it is possible to prepare a back coating layer at the back surface of the substrate of the thermally sensitive recording medium of this invention to improve the preservability. And after each layer is formed with super calendar etc, the treatment to obtain flatness can be carried out, or adhesion chemicals can be mounted over the back surface of the thermally sensitive recording medium to prepare a adhesive label. Furthermore, a various well known technique such as magnetic thermally sensitive layer, printing coating layer or thermally transferring recording layer can be applied to this invention at need.

EXAMPLE

The thermally sensitive recording medium of this invention will be illustrated more concretely by Examples, however, not intended to be limited to them. In the Examples and Comparative Examples, a term of "parts" or % indicates weight part or weight %.

Preparation of Thermally Sensitive Recording Paper

Example 1

In Example 1, 4-hydroxy-4'-methyldiphenylsulfone is used as a color developer, 3-dibutylamino-6-methyl-7-anilinofuloran <ODB-2> is used as a dye precursor and diphenylsulfone(compound 2-1) is used as a sensitizer for thermally sensitive recording medium of this invention. In the first place, dispersion of dye (A solution), dispersion of color developer (B solution) and dispersion of sensitizer (C solution) are separately ground to average particle diameter of 1 $\mu$m by a sand grinder.

| | |
|---|---|
| (A solution: dispersion of dye) | |
| 3-dibutylamino-6-methyl-7-anylinofulloran | 2.0 parts |
| 10% polyvinyl alcohol aqueous solution | 4.6 parts |
| water | 2.6 parts |
| (B solution: dispersion of color developer) | |
| 4-hydroxy-4'-methyldiphenylsulfone | 6.0 parts |
| 10% polyvinyl alcohol aqueous solution | 18.8 parts |
| water | 11.2 parts |
| (C solution: dispersion of sensitizer) | |
| diphenylsulfone | 6.0 parts |
| 10% polyvinyl alcohol aqueous solution | 18.8 parts |
| water | 11.2 parts |

Then A solution, B solution, C solution and dispersion of kaolin clay are mixed by following ratio and stirred, and a thermally sensitive coating is obtained.

| | |
|---|---|
| A solution: dispersion of dye | 9.2 parts |
| B solution: dispersion of color developer | 36.0 parts |
| C solution: dispersion of sensitizer | 36.0 parts |
| Kaolin clay (50% dispersion) | 12.0 parts |

The obtained thermally sensitive coating is coated over the one surface of 50 g/m$^2$ substrate paper and dried up so as the coating amount is 4.0–4.5 g/m$^2$. The obtained sheet is treated by a super calendar so as the smoothness to be 500 sec, thus the thermally sensitive recording medium is prepared.

Example 2

By same process of Example 1, a thermally sensitive recording medium is prepared, except using 4,4'-di(3-methyl-1 -buthoxy)diphenylsulfone (compound 2–10) instead of diphenylsulfone in C solution, which is a sensitizer.

Example 3

By same process of Example 1, a thermally sensitive recording medium is prepared, except using 4,4'-di(2-propenyloxy)diphenylsulfone (compound 2-11) instead of diphenylsulfone in C solution, which is a sensitizer.

Example 4

By same process of Example 1, a thermally sensitive recording medium is prepared, except using 4-hydroxydiphenylsulfone instead of 4-hydroxy-4'-methyldiphenylsulfone in B solution, which is a color developer.

Example 5

By same process of Example 1, a thermally sensitive recording medium is prepared, except using 4-hydroxydiphenylsulfone instead of 4-hydroxy-4'-methyldiphenylsulfone in B solution, which is a color developer and using 4,4'-di(3-methyl-1-buthoxy)diphenylsulfone (compound 2-10) instead of diphenyl sulfone in C solution, which is a sensitizer.

Example 6

By same process of Example 1, a thermally sensitive recording medium is prepared, except using 4-hydroxydiphenylsulfone instead of 4-hydroxy-4'-methyldiphenylsulfone in B solution, which is a color developer and using 4,4'-di(2-propenyloxy)diphenylsulfone (compound 2-11) instead of diphenyl sulfone in C solution, which is a sensitizer.

Example 7

By same process of Example 1, a thermally sensitive recording medium is prepared, except using 4-chloro-4'-hydroxydiphenylsulfone instead of 4-hydroxy-4'-methyldiphenylsulfone in B solution, which is a color developer.

Example 8

By same process of Example 1, a thermally sensitive recording medium is prepared, except using 4-chloro-4'-hydroxydiphenylsulfone instead of 4-hydroxy-4'-methyldiphenylsulfone in B solution, which is a color developer and using 4,4'-di(3-methyl-1-buthoxy)diphenylsulfone (compound 2-10) instead of diphenylsulfone in C solution, which is a sensitizer.

Example 9

By same process of Example 1 a thermally sensitive recording medium is prepared, except using 4-chloro-4'-hydroxydiphenylsulfone instead of 4-hydroxy-4'-methyldiphenylsulfone in B solution, which is a color developer and using 4,4'-di(2-propenyloxy)diphenylsulfone (compound 2-11) instead of diphenylsulfone in C solution, which is a sensitizer.

Example 10

By same process of Example 1, a thermally sensitive recording medium is prepared, except using compound 3-4 instead of compound 2-1 in C solution, which is a sensitizer.

Example 11

By same process of Example 1, a thermally sensitive recording medium is prepared, except using compound 3-2 instead of compound 2-1 in C solution, which is a sensitizer.

Example 12

In Example 12, compound (3-2) and compound (3-4) are used as sensitizers. By same process of Example 1, dispersion of color developer composed of 4-hydroxy-4'-methyldiphenylsulfone, dispersion of <ODB-2>, and dispersions of sensitizer composed of compound (3-2) and compound (3-4) are prepared. Then, these solutions are mixed together by following ratio and stirred, and a thermally sensitive coating is obtained.

| | |
|---|---|
| A solution: dispersion of dye | 9.2 parts |
| B solution: dispersion of color developer | 36.0 parts |
| C solution: sensitizer [compound(3-4)] dispersion | 14.4 parts |
| D solution: sensitizer [compound(3-2)] dispersion | 21.6 parts |
| Kaolin clay (50% dispersion) | 12.0 parts |

Example 13

By same process of Example 1, a thermally sensitive recording medium is prepared, except using 4-hydroxydiphenylsulfone instead of 4-hydroxy-4'-methyldiphenylsulfone in B solution, which is a color developer and using compound (3-4) instead of compound (2-1) in C solution, which is a sensitizer.

Example 14

By same process of Example 1, a thermally sensitive recording medium is prepared, except using 4-hydroxydiphenylsulfone instead of 4-hydroxy-4'-methyldiphenylsulfone in B solution, which is a color developer and using compound (3-2) instead of compound (2-1) in C solution, which is a sensitizer.

Example 15

In Example 15, 4-hydroxydiphenylsulfone is used as a color developer and compound (3-2) and compound (3-4) are used as a sensitizer. By same process to Example 1, dispersion of color developer composed of 4-hydroxydiphenyl sulfone, dispersion of <ODB-2>, and dispersions of sensitizer composed of compound (3-2) and compound (3-4) are prepared. Then, these solutions are mixed by following ratio and stirred to obtain a thermally sensitive coating.

| | |
|---|---|
| A solution: dispersion of dye | 9.2 parts |
| B solution: dispersion of color developer | 36.0 parts |
| C solution: sensitizer [compound(3-4)] dispersion | 14.4 parts |
| D solution: sensitizer [compound(3-2)] dispersion | 21.6 parts |
| Kaolin clay (50% dispersion) | 12.0 parts |

Example 16

By same process of Example 1, a thermally sensitive recording medium is prepared, except using 4-chloro4'-hydroxydiphenylsulfone instead of 4-hydroxy-4'-methyldiphenylsulfone in B solution, which is a color developer and using compound (3-4) instead of compound (2-1) in C solution, which is a sensitizer.

Example 17

By same process of Example 1, a thermally sensitive recording medium is prepared, except using 4-chloro-4'-hydroxydiphenylsulfone instead of 4-hydroxy-4'-methyldiphenylsulfone in B solution, which is a color developer and using compound (3-2) instead of compound (2-1) in C solution, which is a sensitizer.

Example 18

In Example 18, 4-chloro-4'-hydroxydiphenylsulfone is used as a color developer and compound (3-2) and compound (3-4) are used as a sensitizer. By same process to Example 1, dispersion of color developer composed of 4-chloro-4'-hydroxydiphenylsulfone, dispersion of <ODB-2>, and dispersions of sensitizer composed of compound (3-2) and compound (3-4) are prepared. Then, these solutions are mixed by following ratio and stirred to obtain a thermally sensitive coating.

| | |
|---|---|
| A solution: dispersion of dye | 9.2 parts |
| B solution: dispersion of color developer | 36.0 parts |
| C solution: sensitizer [compound(3-4)] dispersion | 14.4 parts |
| D solution: sensitizer [compound(3-2)] dispersion | 21.6 parts |
| Kaolin clay (50% dispersion) | 12.0 parts |

Comparative Example 1

By same process of Example 1, a thermally sensitive recording medium is prepared, except using ethylenebisstearoamide <Armowax> instead of diphenylsulfone (compound 2-1) in the preparation of sensitizer dispersion (C solution) of Example 1.

Comparative Example 2

By same process of Example 4, a thermally sensitive recording medium is prepared, except using ethylenebisstearoamide <Armowax> instead of diphenylsulfone (compound 2-1) in the preparation of sensitizer dispersion (C solution) of Example 4.

Comparative Example 3

By same process of Example 7, a thermally sensitive recording medium is prepared, except using ethylenebisstearoamide <Armowax> instead of diphenylsulfone (compound 2-1) in the preparation of sensitizer dispersion (C solution) of Example 7.

Evaluation of the Thermally Sensitive Recording Medium

Color Developing Method

Thermal recording is carried out on the prepared thermally sensitive recording media using TH-PMD (printing tester for thermally sensitive recording paper, thermal head of Kyocera Co., Ltd. is installed), which is a product of Ohkura Denki Co., by 0.25 and 0.33 mJ/dot impressive energy. Image density of the recorded part and the blank white paper part are measured by means of a Macbeth densitometer (RD-914, umber filter used). And following tests are carried out on the specimen.

Evaluation Test for Humidity Resistance

A specimen printed by 0.33 mJ/dot impressive energy is left for 24 hrs in a condition of 90%RH humidity and 40° C. temperature, then the density of printed part and blank white paper part are measured by a Macbeth densitometer.

Evaluation Test for Heat Resistance Test

A specimen printed by 0.33 mJ/dot impressive energy is left for 24 hrs in a condition of 60° C. temperature, then the density of printed part and blank white paper part are measured by a Macbeth densitometer.

The results in regard to color developing ability and preservability are summarized in Table 1 and Table 2. Bigger numerical value of the printed part indicates better image preservability, and smaller numerical value of the blank white paper part indicates better background color stability.

TABLE 1

| color developing test | | | |
|---|---|---|---|
| | | developed color density | |
| | sensitizer | 0.25 mJ/dot | 0.33 mJ/dot |
| Example 1 | (2-1) | 1.03/0.07 | 1.33/0.07 |
| Example 2 | (2-10) | 1.12/0.07 | 1.36/0.07 |
| Example 3 | (2-11) | 1.01/0.07 | 1.32/0.07 |
| Example 4 | (2-1) | 1.17/0.07 | 1.44/0.07 |
| Example 5 | (2-10) | 1.26/0.07 | 1.46/0.07 |
| Example 6 | (2-11) | 1.15/0.07 | 1.43/0.07 |
| Example 7 | (2-1) | 0.93/0.07 | 1.30/0.07 |
| Example 8 | (2-10) | 1.03/0.07 | 1.34/0.07 |
| Example 9 | (2-11) | 0.92/0.07 | 1.28/0.07 |
| Example 10 | (3-4) | 1.02/0.07 | 1.35/0.07 |
| Example 11 | (3-2) | 0.83/0.07 | 1.27/0.07 |
| Example 12 | (3-4)(3-2) | 0.82/0.07 | 1.26/0.07 |
| Example 13 | (3-4) | 1.13/0.08 | 1.36/0.08 |
| Example 14 | (3-2) | 0.98/0.07 | 1.30/0.08 |
| Example 15 | (3-4)(3-2) | 0.95/0.07 | 1.30/0.08 |
| Example 16 | (3-4) | 0.92/0.07 | 1.30/0.07 |
| Example 17 | (3-2) | 0.82/0.07 | 1.25/0.07 |
| Example 18 | (3-4)(3-2) | 0.80/0.07 | 1.23/0.07 |
| Co. Example 1 | Armowax | 0.62/0.07 | 1.18/0.07 |
| Co. Example 2 | Armowax | 0.72/0.07 | 1.20/0.07 |
| Co. Example 3 | Armowax | 0.50/0.07 | 1.12/0.07 |

Remarks
Numerical value in Table 1 and also in Table 2 indicates
(Macbethe value of printed part)/(Macbeth value of blank part)

TABLE 2

| resistance to humid test and heat resistance test | | |
|---|---|---|
| No. | resistance to humidity | resistance to heat |
| Example 1 | 1.20/0.07 | 1.23/0.10 |
| Example 2 | 1.21/0.08 | 1.25/0.11 |
| Example 3 | 1.18/0.07 | 1.20/0.10 |
| Example 4 | 1.30/0.07 | 1.34/0.14 |
| Example 5 | 1.33/0.08 | 1.36/0.15 |
| Example 6 | 1.27/0.07 | 1.33/0.14 |
| Example 7 | 1.18/0.08 | 1.22/0.11 |
| Example 8 | 1.20/0.09 | 1.23/0.12 |
| Example 9 | 1.15/0.08 | 1.20/0.11 |
| Example 10 | 1.04/0.07 | 1.24/0.10 |
| Example 11 | 1.01/0.07 | 1.12/0.09 |
| Example 12 | 0.98/0.07 | 1.20/0.10 |
| Example 13 | 1.05/0.07 | 1.27/0.14 |
| Example 14 | 1.03/0.07 | 1.17/0.13 |
| Example 15 | 1.00/0.07 | 1.24/0.14 |
| Example 16 | 1.01/0.07 | 1.21/0.11 |
| Example 17 | 1.07/0.07 | 1.11/0.09 |
| Example 18 | 0.95/0.07 | 1.19/0.10 |
| Co. Example 1 | 0.93/0.09 | 1.04/0.12 |
| Co. Example 2 | 0.93/0.09 | 1.06/0.15 |
| Co. Example 3 | 0.90/0.10 | 1.01/0.13 |

It is clearly understood from the results mentioned above, that the sensitivity of Examples 1–3 and Examples 10–12, in which 4-hydroxy-4'-methyldiphenylsulfone is used as a color developer and use a compound represented by general formula (2) or (3) is used as a sensitizer, are remarkably improved at the lower impressive energy compared with the Comparative Example 1, in which a conventional sensitizer is used. Further, the resistance to humidity and heat resistance show good results, despite the sensitivity is improved.

In cases of Examples 4–6 and Examples 13–15, in which 4-hydroxy-diphenylsulfone is used as a color developer and a compound represented by general formula (2) or (3) is used as a sensitizer, it is obvious that the sensitivity at lower impressive energy is remarkably improved compared to the Comparative Example 2, in which a conventional sensitizer is used. Further, the resistance to humidity shows good result, despite the sensitivity is improved.

Further, in cases of Examples 7–9 and Examples 16–18, in which 4-chloro -4'-hydroxydiphenylsulfone is used as a color developer and a compound represented by general formula (2) or (3) is used as a sensitizer, it is obvious that the sensitivity at lower impressive energy is remarkably improved compared to the Comparative Example 3 in which a conventional sensitizer is used. Furthermore, the resistance to humid and heat resistance show good results, despite the sensitivity is improved.

Effect of the Invention

The thermally sensitive recording medium of this invention has a sufficient ability to develop color of dye precursor at lower impressive energy by containing a compound represented by general formula (2) or (3), when a compound represented by general formula (1) is used as a color developer. Further, since this thermally sensitive recording medium shows good image preservability at recorded part and good resistance to humidity at blank white paper part and background color stability against heat, it should be a very useful product.

What is claimed is:

1. A thermally sensitive recording medium that possesses on a substrate a thermally sensitive color developing layer containing a colorless or pale colored basic dye precursor, and a color developer that reacts with the dye precursor and makes said dye precursor develop color when heated, characterized by containing;

(a) a compound represented by general formula (1) as the color developer, and (b) a compound represented by general formula (2) or general formula (3) as a sensitizer, (1)

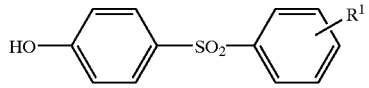

(2)

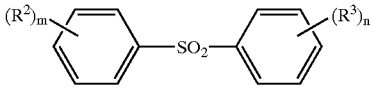

(3)

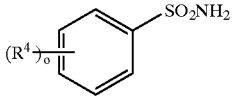

wherein $R^1$ represents a hydrogen atom, a methyl group or a chlorine atom, $R^2$ and $R^3$ represents a hydrogen atom, a methyl group, an alkoxy group or an allyloxy group, m and n represent an integer of 1–5, $R^4$ represents an alkyl group, an alkoxy group of carbon number 1–6 or an electron withdrawing and o represents an integer of 0–2.

2. The thermally sensitive recording medium of claim 1, wherein a color developer is 4-hydroxy-4'-methyldiphenylsulfone.

3. The thermally sensitive recording medium of claim 1, wherein a color developer is 4-hydroxydiphenylsulfone.

4. The thermally sensitive recording medium of claim 1, wherein said color developer is 4-hydroxy-4'-chlorodiphenylsulfone.

* * * * *